US008355645B2

(12) United States Patent
Mizumukai

(10) Patent No.: US 8,355,645 B2
(45) Date of Patent: Jan. 15, 2013

(54) IMAGE FORMING DEVICE FOR MAKING QUALITY ADJUSTMENTS BASED ON CALIBRATION DATA, AND METHOD AND COMPUTER READABLE MEDIUM THEREFOR

(75) Inventor: Wataru Mizumukai, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 715 days.

(21) Appl. No.: 12/509,750

(22) Filed: Jul. 27, 2009

(65) Prior Publication Data

US 2010/0021188 A1 Jan. 28, 2010

(30) Foreign Application Priority Data

Jul. 28, 2008 (JP) ..... 2008-193638

(51) Int. Cl.
*G03G 15/00* (2006.01)

(52) U.S. Cl. ..... 399/72; 399/160; 358/1.9; 358/3.28

(58) Field of Classification Search ..... 399/49, 399/72, 160
See application file for complete search history.

(56) References Cited

U.S. PATENT DOCUMENTS 4,809,039 A * 2/1989 Ishii ..... 399/72
5,448,277 A * 9/1995 Long ..... 347/129
5,450,165 A * 9/1995 Henderson ..... 399/49
5,650,804 A * 7/1997 Kawamura et al. ..... 347/19
6,002,489 A * 12/1999 Murai et al. ..... 358/406
6,473,153 B2 * 10/2002 Iguchi et al. ..... 355/40
6,538,770 B1 * 3/2003 Mestha ..... 358/1.9
7,068,952 B2 * 6/2006 Tamaoki ..... 399/2
7,916,614 B2 * 3/2011 Harada ..... 369/173
8,130,391 B2 * 3/2012 Gonzalez et al. ..... 358/1.15
8,150,283 B2 * 4/2012 Hosier ..... 399/49
8,152,272 B2 * 4/2012 Kawaguchi et al. ..... 347/35

(Continued)

FOREIGN PATENT DOCUMENTS

JP HEI9-258939 10/1997

(Continued)

OTHER PUBLICATIONS

Japanese Official Action dated Jun. 1, 2010 together with English translation.

*Primary Examiner* — David Gray
*Assistant Examiner* — Geoffrey Evans
(74) *Attorney, Agent, or Firm* — Scully, Scott, Murphy & Presser, P.C.

(57) ABSTRACT

An image forming device, configured to make image quality adjustment based on calibration data, includes a storage configured to store the calibration data for the image quality adjustment, an acquiring unit configured to acquire first image data, a converter configured to, when a predetermined condition is satisfied, convert the first image data acquired by the acquiring unit into second image data by placing, into the first image data, test pattern data for forming one or more test patterns, an image forming unit configured to form an image based on the second image data on an image-formed body thereof, a sensor configured to measure densities of the test patterns included in the image formed on the image-formed body, and a modifying unit configured to modify the calibration data stored on the storage based on the densities measured by the sensor.

18 Claims, 10 Drawing Sheets

U.S. PATENT DOCUMENTS

| | | | | |
|---|---|---|---|---|
| 8,155,549 | B2 * | 4/2012 | Boness et al. | 399/72 |
| 2001/0015815 | A1 * | 8/2001 | Hada et al. | 358/1.9 |
| 2003/0026624 | A1 * | 2/2003 | Sakata et al. | 399/49 |
| 2006/0214979 | A1 * | 9/2006 | Inoue | 347/22 |
| 2006/0233561 | A1 * | 10/2006 | Yamaoka | 399/49 |
| 2006/0285863 | A1 * | 12/2006 | Noguchi et al. | 399/49 |
| 2008/0080876 | A1 * | 4/2008 | Facci et al. | 399/27 |
| 2008/0247770 | A1 * | 10/2008 | Morales et al. | 399/49 |

FOREIGN PATENT DOCUMENTS

| | | |
|---|---|---|
| JP | 2002-166633 | 6/2002 |
| JP | 2003-173063 A | 6/2003 |
| JP | 2005-091766 A | 4/2005 |
| JP | 2007-20111 | 1/2007 |

* cited by examiner

IMAGE FORMING DEVICE FOR MAKING QUALITY ADJUSTMENTS BASED ON CALIBRATION DATA, AND METHOD AND COMPUTER READABLE MEDIUM THEREFOR

CROSS-REFERENCE TO RELATED APPLICATIONS

This application claims priority under 35 U.S.C. §119 from Japanese Patent Application No. 2008-193638 filed on Jul. 28, 2008. The entire subject matter of the application is incorporated herein by reference.

BACKGROUND

1. Technical Field

The following description relates to one or more techniques to adjust image quality of an image to be formed on a sheet based on information regarding the density of a test pattern.

2. Related Art

An image forming device (such as a laser printer) has been known, which is configured to form, on a sheet, an image based on image data received from an external device such as a personal computer operated by a user.

In addition, as a method for adjusting image quality of an image formed on a sheet by an image forming device, a calibration operation has been known in which test pattern data (commonly known as patch data) is provided to the image forming device, and a test pattern based on the test pattern data is formed on a sheet by the image forming device, and the image quality is adjusted through optically scanning the density of the test pattern (for example, see Japanese Patent Provisional Publication No. HEI9-258939).

Such a calibration operation is repeatedly performed in an image forming device (such as a laser printer) with predetermined frequency to prevent deterioration of the image quality. For example, in the known image forming device, the calibration operation is performed each time a predetermined time period has elapsed or each time a predetermined number of sheets are printed. Furthermore, since input/output (I/O) characteristics of the image forming device vary depending on temperature and/or humidity, so far the calibration operation has been carried out in response to changes in the environment.

SUMMARY

In the meantime, a main function of the image forming device (such as a laser printer) is to form on a sheet an image based on image data received from an external device such as a personal computer operated by a user.

However, during execution of the calibration operation, the known image forming device cannot perform an image forming operation based on the image data received from the external device. Therefore, there is a problem that the user may feel frustration when a user-desired operation is broken due to the execution of the calibration operation.

Aspects of the present invention are advantageous to provide one or more improved image forming devices (and methods and computer readable media therefor) that make it possible to prevent a user from feeling discontented with a user-desired image forming operation interrupted by a calibration operation.

According to aspects of the present invention, an image forming device configured to make image quality adjustment based on calibration data is provided. The image forming device includes a storage configured to store the calibration data for the image quality adjustment, an acquiring unit configured to acquire first image data, a converter configured to, when a predetermined condition is satisfied, convert the first image data acquired by the acquiring unit into second image data by placing, into the first image data, test pattern data for forming one or more test patterns, an image forming unit configured to form an image based on the second image data on an image-formed body thereof, a sensor configured to measure densities of the test patterns included in the image formed on the image-formed body, and a modifying unit configured to modify the calibration data stored on the storage based on the densities measured by the sensor.

In some aspects of the present invention, when a predetermined condition is satisfied, the converter creates the second image data with the test pattern data for forming one or more test patterns added to the first image data. The image forming unit forms an image based on the second image data created by the converter on the image-formed body. It is noted that the image based on the second data contains an image based on the first image data and the test patterns based on the test pattern data. Then, the sensor measures the densities of the test patterns contained in the image formed on the image-formed body based on the second image data. Thus, the calibration data for the image quality adjustment is modified based on the densities measured by the sensor.

In some aspects of the present invention, the image forming device configured as above makes it possible to perform a calibration operation (the image quality adjustment) using the calibration data in parallel with the image forming operation based on the second image data, unlike a known technique to perform a calibration operation separately from the image forming operation.

Thus, the image forming device configured as above makes it possible to prevent a user from feeling discontented with the image forming operation interrupted by the calibration operation.

Optionally, the aforementioned predetermined condition may include a condition that a predetermined time period has elapsed since the last time the calibration data was modified.

According to aspects of the present invention, further provided is a method for making image quality adjustment based on calibration data. The method includes a storing step of storing the calibration data for the image quality adjustment, an acquiring step of acquiring first image data, a converting step of, when a predetermined condition is satisfied, converting the first image data acquired in the acquiring step into second image data by placing, into the first image data, test pattern data for forming one or more test patterns, a forming step of forming an image based on the second image data on an image-formed body, a measuring step of measuring densities of the test patterns included in the image formed on the image-formed body, and a modifying step of modifying the calibration data stored in the storing step based on the densities measured in the measuring step.

In some aspects of the present invention, the method adapted as above can provide the same effects as the aforementioned image forming device.

According to aspects of the present invention, further provided is a computer readable medium having computer readable instructions stored thereon, the instructions causing a computer to perform a storing step of storing calibration data for image quality adjustment, an acquiring step of acquiring first image data, a converting step of, when a predetermined condition is satisfied, converting the first image data acquired in the acquiring step into second image data by placing, into the first image data, test pattern data for forming one or more test patterns, a forming step of forming an image based on the second image data on an image-formed body, a measuring step of measuring densities of the test patterns included in the image formed on the image-formed body, and a modifying step of modifying the calibration data stored in the storing step based on the densities measured in the measuring step.

In some aspects of the present invention, the computer readable medium adapted as above can provide the same effects as the aforementioned image forming device and method.

BRIEF DESCRIPTION OF THE ACCOMPANYING DRAWINGS

Figure 6:
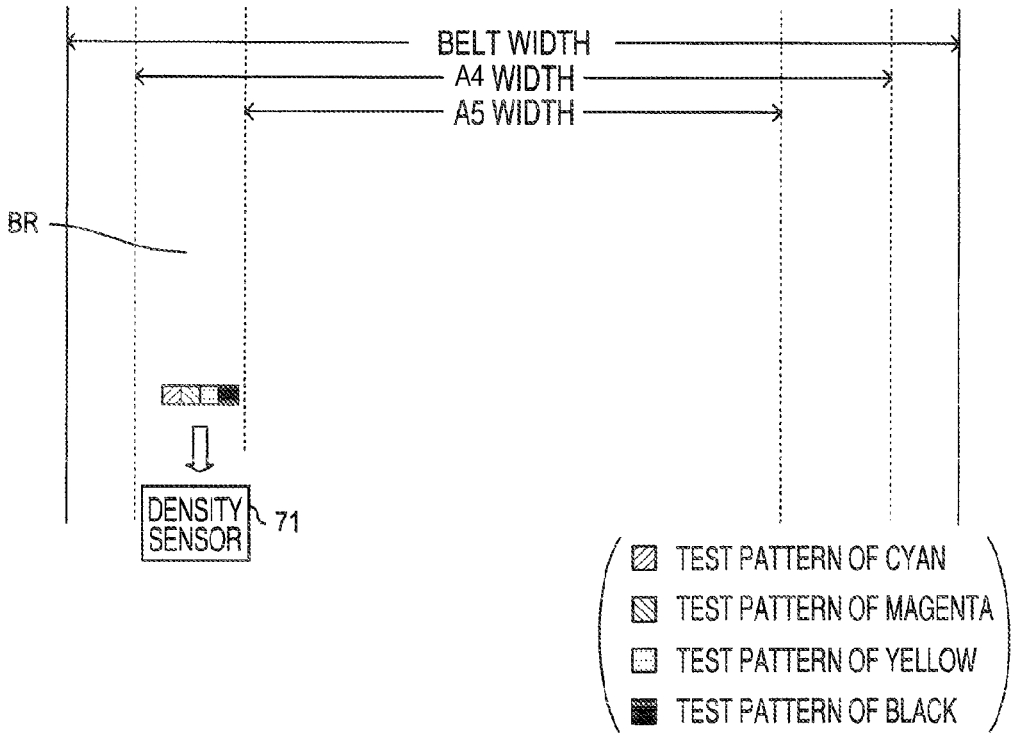

FIG. 6 schematically shows a positional relationship between a setting position of a density sensor and a position where test patterns are formed in the embodiment according to one or more aspects of the present invention.

Figure 7:
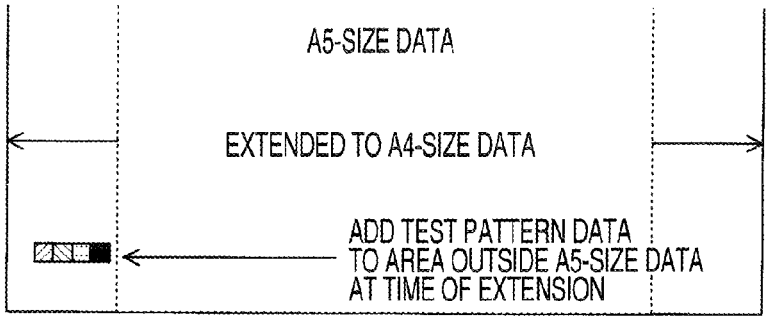

FIG. 7 shows an example in which print image data is extended with the test patterns added to an area outside the print image data in the embodiment according to one or more aspects of the present invention.

Figure 8:
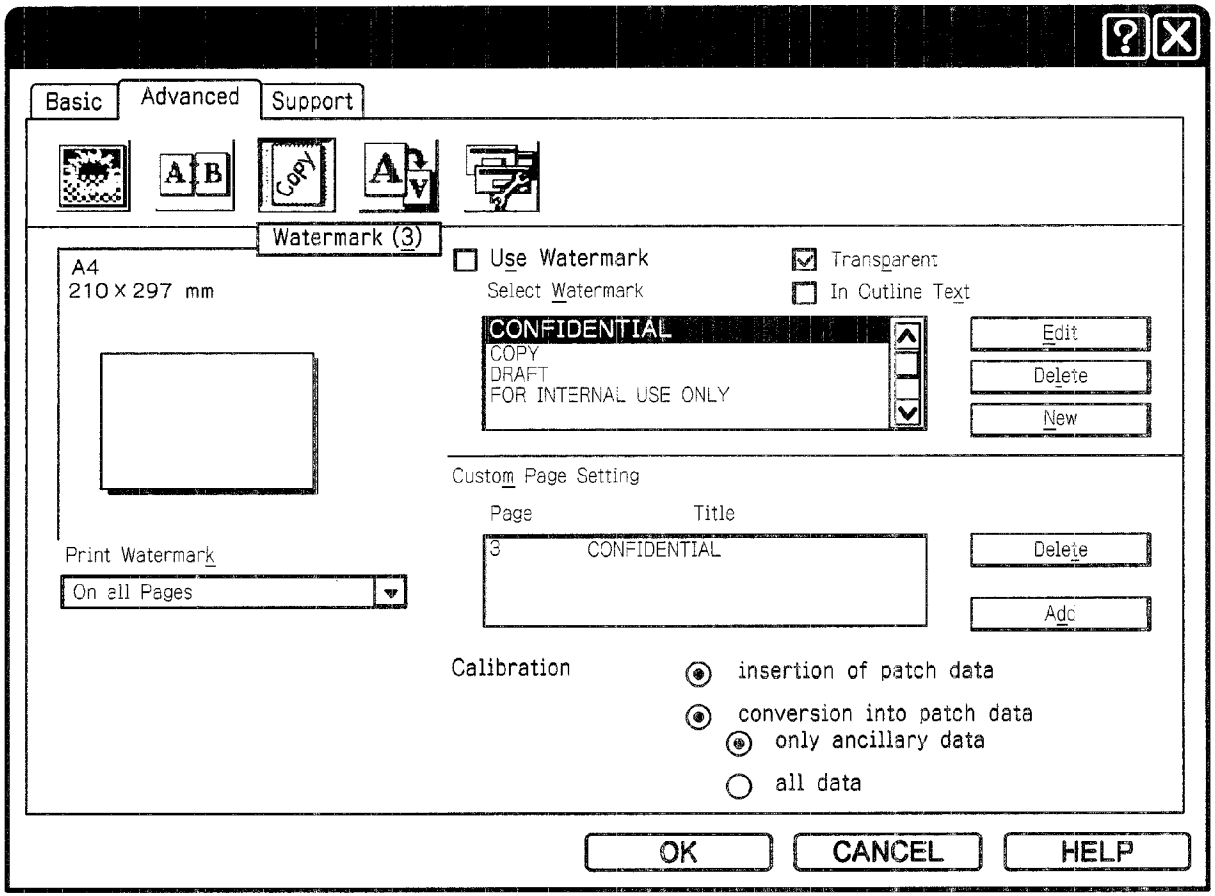

FIG. 8 shows a configuration of a printer setting screen in the embodiment according to one or more aspects of the present invention.

Figure 9A:
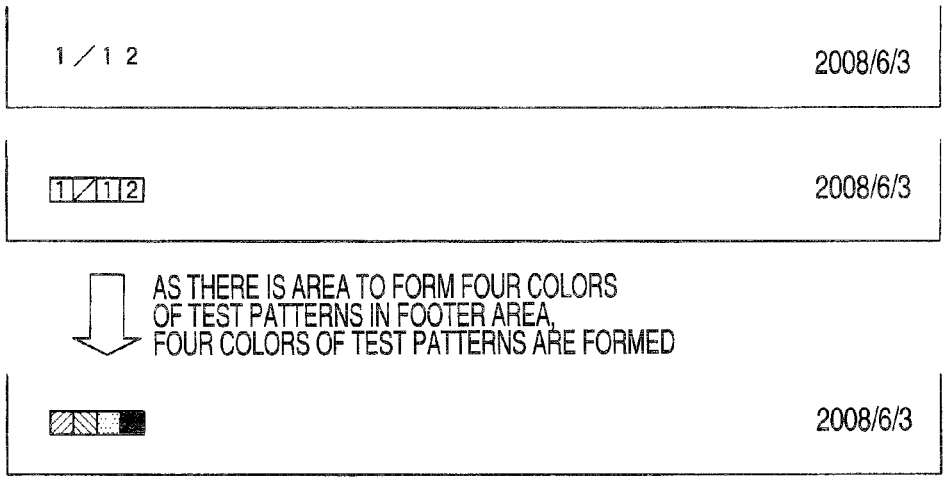
Figure 9B:
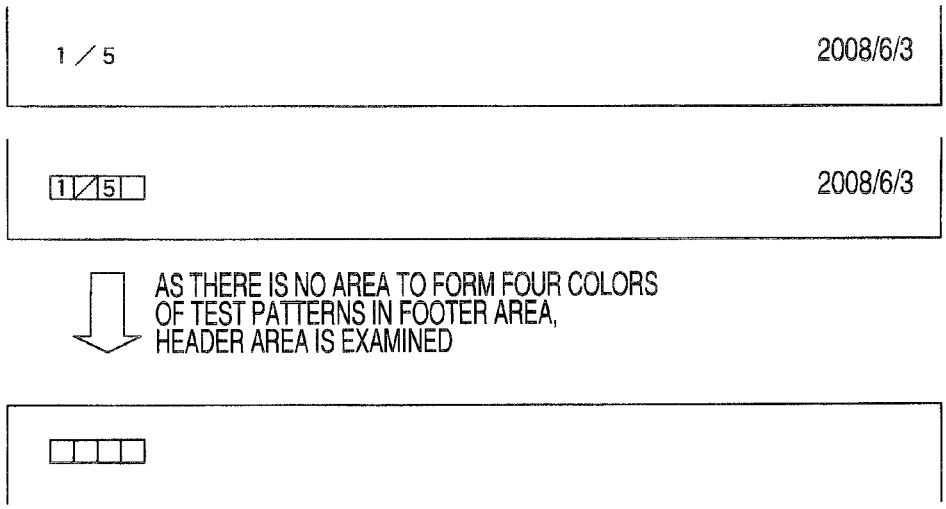

FIGS. 9A and 9B show examples in each of which ancillary data is replaced with all-color test pattern data in the embodiment according to one or more aspects of the present invention.

Figure 10:
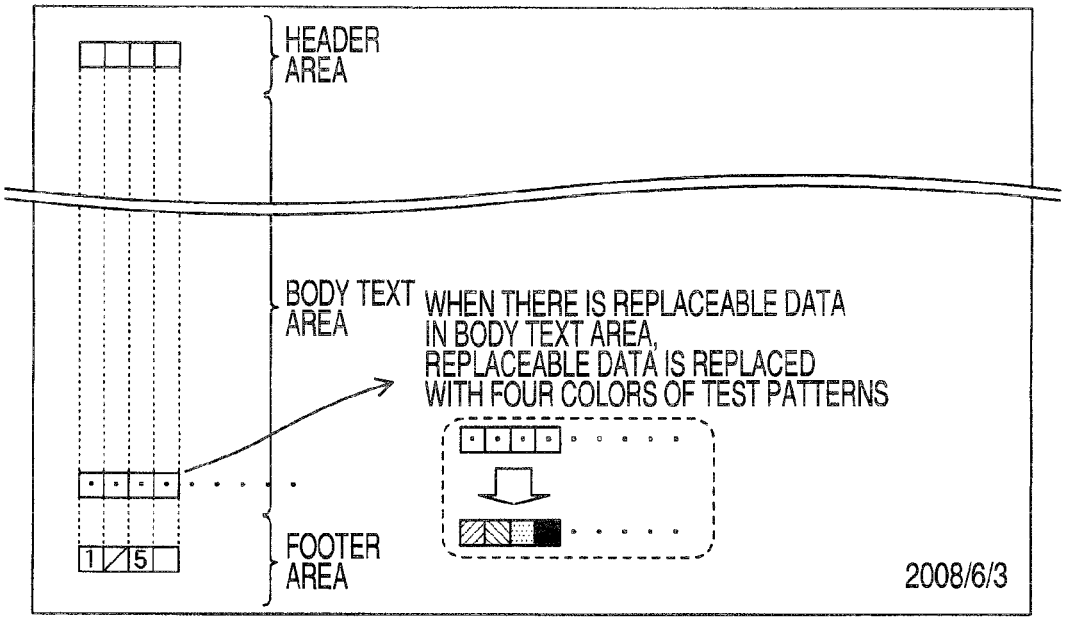

FIG. 10 shows an example in which body text data is replaced with the test pattern data in the embodiment according to one or more aspects of the present invention.

Figure 11:
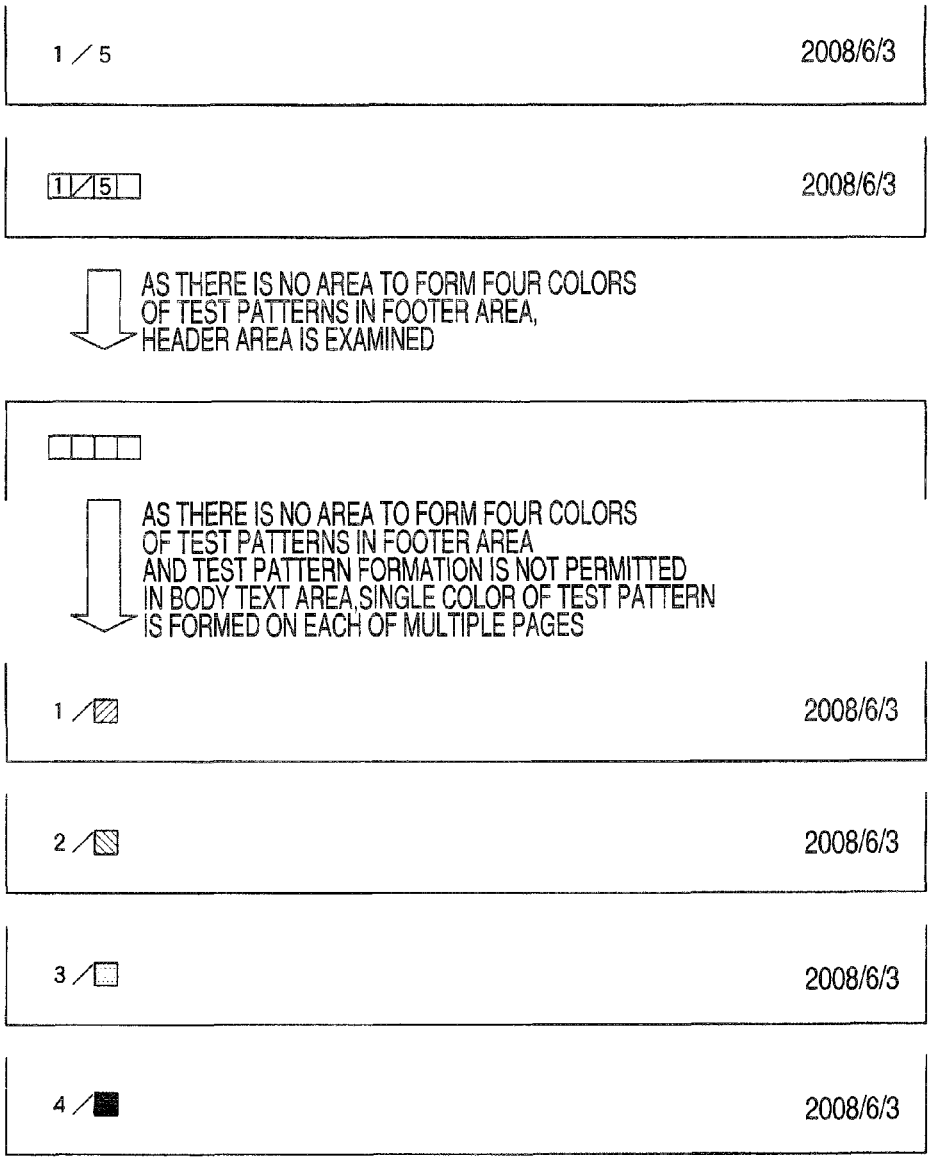

FIG. 11 shows an example, in which ancillary data is replaced with a separated piece of the test pattern data on each of a plurality of pages, in the embodiment according to one or more aspects of the present invention.

Figure 12:
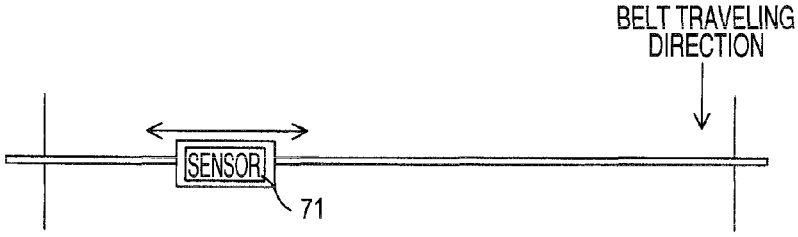

FIG. 12 schematically shows a configuration of a density sensor in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Figure 1:
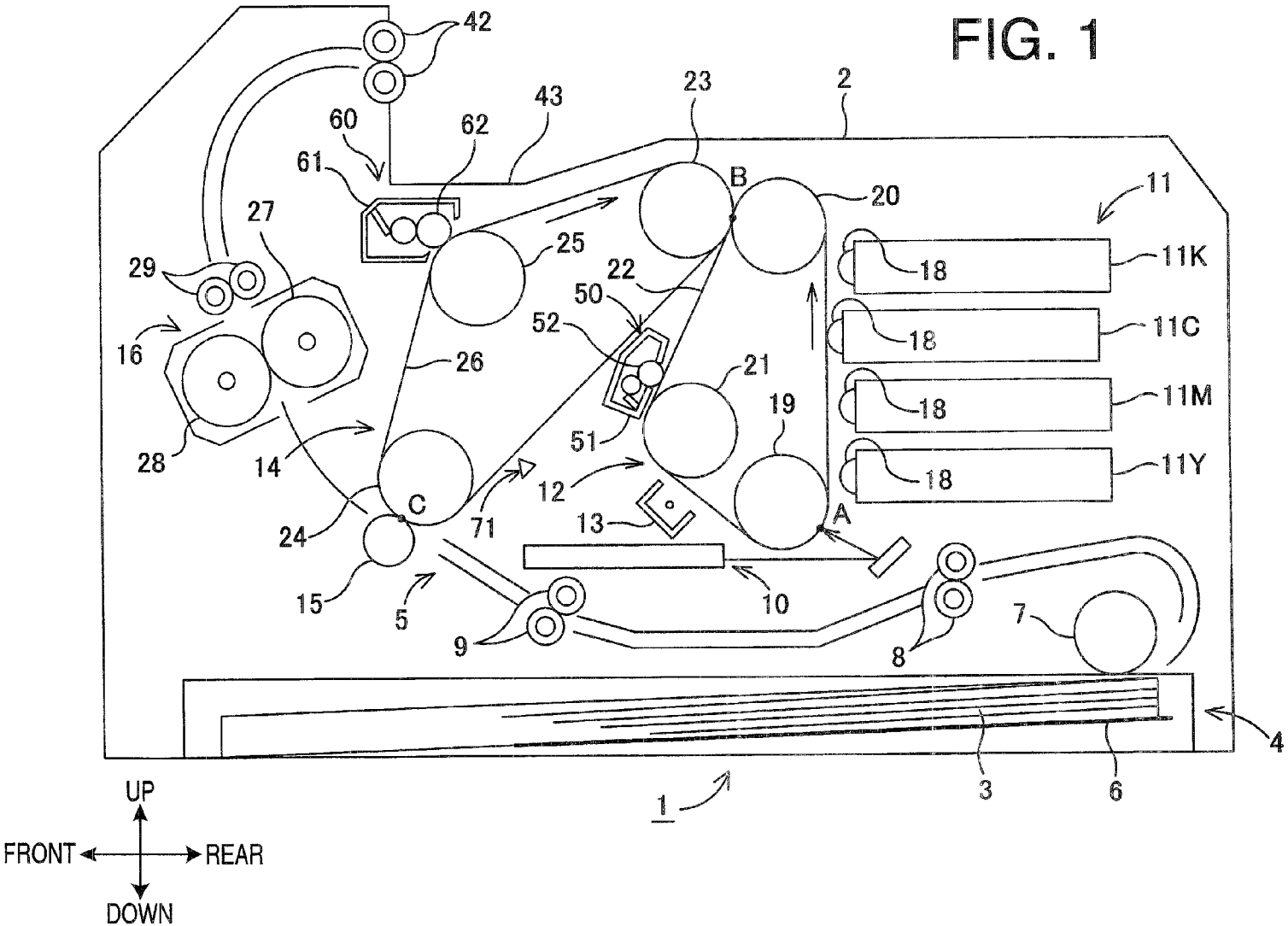
FIG. 1 is a cross-sectional view schematically showing a main part of a laser printer in an embodiment according to one or more aspects of the present invention.

Hereinafter, an embodiment according to aspects of the present invention will be described with reference to the accompany drawings. As shown in FIG. 1, the laser printer 1 in the embodiment is a color laser printer that has, inside a main body casing 2, a sheet feeder 4 configured to feed sheets 3 and an image forming unit 5 configured to form an image on a sheet 3 fed by the sheet feeder 4.

The sheet feeder 4 is provided with a feed tray 6, a feed roller 7, carrier rollers 8, and registration rollers 9. By rotation of the feed roller 7 that establishes pressure contact with a top sheet of the sheets 3 stacked on the feed tray 6, the sheets 3 are fed on a sheet-by-sheet basis, via the carrier rollers 8 and the registration rollers 9, to the image forming unit 5.

Meanwhile, the image forming unit 5 includes a scanner unit 10, a development unit 11, a photoconductive belt mechanism 12, an electrification charger 13, an intermediate transfer belt mechanism 14, a transfer roller 15, and a fixing unit 16. The scanner unit 10 includes a laser emitting unit and a polygon mirror for scanning a laser beam along a scanning direction perpendicular to a traveling direction of the photoconductive belt 22. The scanner unit 10 is configured to render a laser beam emitted by the laser emitting unit incident onto a surface of the photoconductive belt 22 via the polygon mirror and to form an electrostatic latent image in an exposure point A on the surface of the photoconductive belt 22.

The development unit 11 includes a cyan development cartridge 11C configured to contain toner of cyan (C) as developer, a magenta development cartridge 11M configured to contain toner of magenta (M), a yellow development cartridge 11Y configured to contain toner of yellow (Y), and a black development cartridge 11K configured to contain toner of black (K) as developer.

The development cartridges 11C, 11M, 11Y, and 11K are arranged at a rear side within the main body casing 2, in the vertical direction at intervals of a predetermined distance in parallel with each other. Further, each of the development cartridges 11C, 11M, 11Y, and 11K is configured with a development roller 18 capable of getting in contact with and away from the surface of the photoconductive belt 22. Specifically, when developing the electrostatic latent image formed on the photoconductive belt 22, each of the development cartridges 11C, 11M, 11Y, and 11K develops the electrostatic latent image by supplying the toner to the photoconductive belt 22 with the development roller 18 in contact with the photoconductive belt 22.

The photoconductive belt mechanism 12 is provided inside the laser printer 1 in common with the development cartridges 11C, 11M, 11Y, and 11K. In addition, the photoconductive belt mechanism 12 includes photoconductive belt rollers 19 to 21 and a photoconductive belt 22. Further, the photoconductive belt mechanism 12 is disposed in front of the development unit 11 to face the development unit 11.

Specifically, the photoconductive belt 22 is configured as an endless belt and wound around the photoconductive belt rollers 19 to 21. In other words, the photoconductive belt 22 is attached with the inside thereof in contact with the photoconductive belt rollers 19 to 20 disposed in a triangle shape. Further, the photoconductive belt 22 is moved in a circumferential direction around the photoconductive rollers 19 to 21 in accordance with a rotational motion of the photoconductive belt roller 20 driven by a motor (not shown).

The electrification charger 13 is configured to electrostatically charge the surface of the photoconductive belt 22. The electrification charger 13 is disposed a predetermined distance away from the photoconductive belt 22, in an upstream position relative to the exposure point A in the traveling direction of the photoconductive belt 22. It is noted that electrification of the surface of the photoconductive belt 22 with the electrification charger 13 is implemented as a frontend process for forming the electrostatic latent image by exposing the surface of the photoconductive belt 22 to the laser beam.

The intermediate transfer belt mechanism 14 is configured with intermediate transfer belt rollers 23 to 25 and an intermediate transfer belt 26 and disposed in front of the photoconductive belt mechanism 12. Specifically, the intermediate transfer belt roller 23 is disposed to face the photoconductive belt roller 20 across the photoconductive belt 22 and the intermediate transfer belt 26. The intermediate transfer belt roller 24 is disposed at a lower front side relative to the intermediate transfer belt roller 23 so as to face the transfer roller 15 across the intermediate transfer belt 26. The intermediate transfer belt roller 25 is disposed at a lower front side relative to the intermediate transfer belt roller 23, above the intermediate transfer belt roller 24. Moreover, the intermediate transfer belt 26 is configured as an endless belt and wound around the intermediate transfer belt rollers 23 to 25.

In other words, the intermediate transfer belt 26 is disposed to contact the photoconductive belt 22 between the intermediate transfer belt roller 23 and the photoconductive belt roller 20. A driving force is transmitted to the intermediate transfer belt 26 by the intermediate transfer belt roller 23 driven by a motor (not shown). Then, the intermediate transfer belt 26 is moved in a circumferential direction around the intermediate transfer belt rollers 23 to 25 in conjunction with the turning movement of the photoconductive belt 22.

With the above configuration, a developer image of each color that is formed on the photoconductive belt 22 is transferred onto the intermediate transfer belt 26 in a primary transfer point B. It is noted that the developer images of the four colors, which are separately formed on the photoconductive belt 22, are transferred onto the intermediate transfer belt 26 in a superimposed manner. Through such operations, a color developer image is formed on the intermediate transfer belt 26 with the developer images of four colors formed on the photoconductive belt 22 being mutually superimposed.

The transfer roller 15 is configured to get in contact with and away from the intermediate transfer belt 26. Further, the transfer roller 15 is disposed to face the intermediate transfer belt roller 24 across the intermediate transfer belt 26. By pressing a sheet 3 fed by the registration rollers 9 against the intermediate transfer belt 26 with a predetermined transfer bias being applied to the transfer roller 15 by a transfer bias applying circuit (not shown), the transfer roller 15 transfers the color developer image formed on the intermediate transfer belt 26 onto the sheet 3 in a secondary transfer point C.

The fixing unit 16 is provided with a heating roller 27 and a pressing roller 28 configured to press the heating roller 27. The fixing unit 16 is disposed at a downstream side in a feeding direction of the sheets 3 relative to the transfer roller 15, in front of the intermediate transfer belt mechanism 14. When the sheet 3, on which a color image is formed with the developer image transferred from the intermediate transfer belt 26 in the secondary transfer point C, passes between the heating roller 27 and the pressing roller 28, the color image is fixed on the sheet 3. Then, the sheet 3 with the color image fixed thereon is ejected onto a catch tray 43 via feed rollers 29 and discharge rollers 42.

In addition, the image forming unit 5 cleans the photoconductive belt 22 and the intermediate transfer belt 26 with a photoconductive belt cleaning device 50 and an intermediate transfer belt cleaning device 60, respectively.

Specifically, the photoconductive belt cleaning device 50 is disposed to face the photoconductive belt 22 at a downstream side in the traveling direction of the photoconductive belt 22 relative to the primary transfer point B. The photoconductive belt cleaning device 50 electrically captures remaining toner adhered to the photoconductive belt 22 with a photoconductive belt cleaning roller 52 which contacts the photoconductive belt 22. Then, the captured toner is stored in a photoconductive belt cleaning box 51.

Additionally, the intermediate transfer belt cleaning device 60 is disposed to face the intermediate transfer belt 26 at a downstream side in a traveling direction of the intermediate transfer belt 26 relative to the secondary transfer point C. The intermediate transfer belt cleaning device 60 electrically captures remaining toner adhered to the intermediate transfer belt 22 with an intermediate transfer belt cleaning roller 62 which contacts the intermediate transfer belt 26. Then, the captured toner is stored in an intermediate transfer belt cleaning box 61. It is noted that the intermediate transfer belt cleaning roller 62 is configured to get in contact with and away from the intermediate transfer belt 26, and rendered in contact with the intermediate transfer belt 26 when the intermediate transfer belt 26 is required to be cleaned.

In the meantime, each element included in the image forming unit 5 and the feed unit 4 in the aforementioned configuration is controlled by a controller 100 of the laser printer 1. Hereinafter, the image forming unit 5 and the feed unit 4 will be referred as a whole to as a recording device 70.

Figure 2:
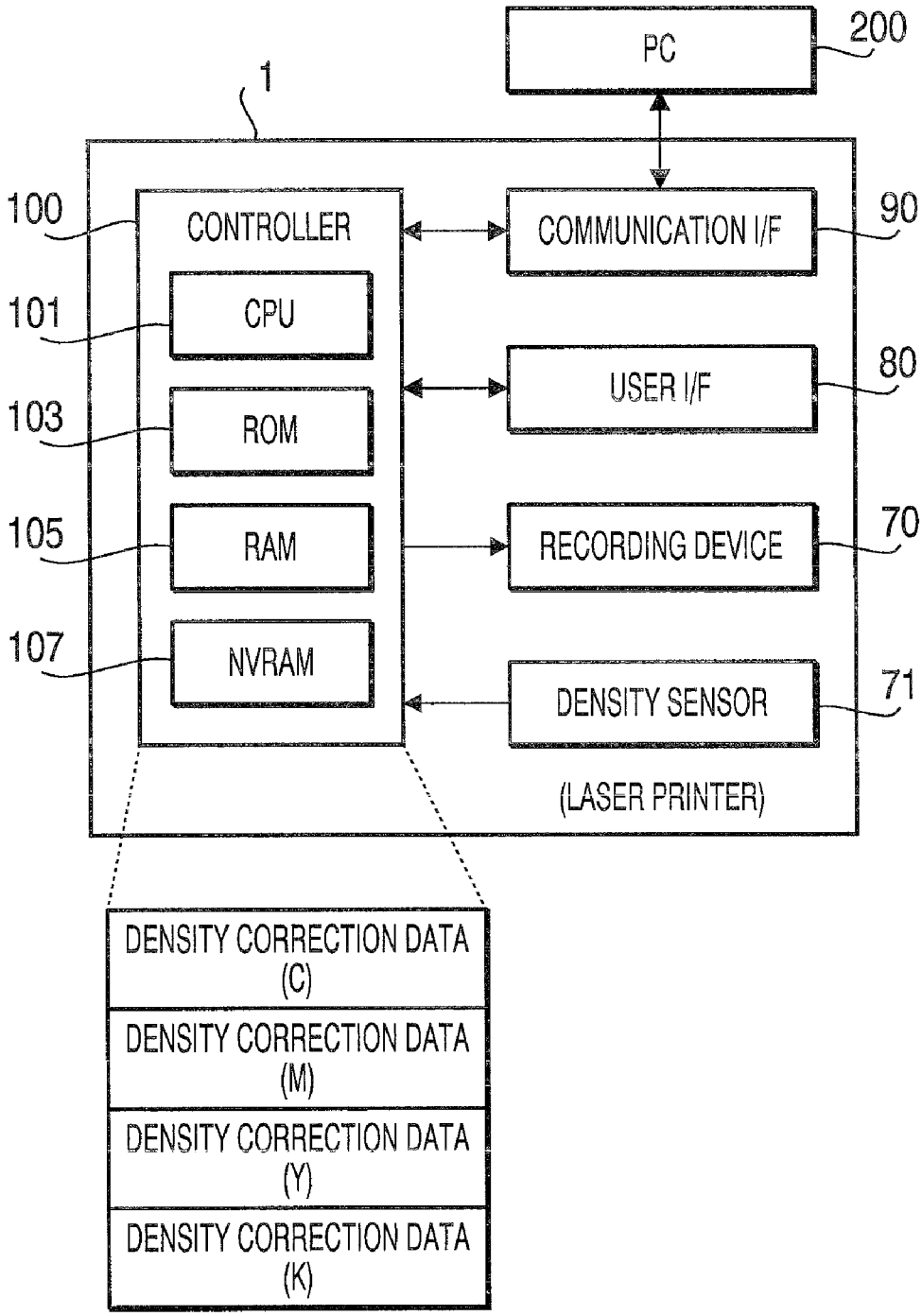
FIG. 2 is a block diagram showing an electrical configuration of the laser printer in the embodiment according to one or more aspects of the present invention.

As illustrated in FIG. 2, the laser printer 1 in the embodiment includes, as well as the recoding device 70, a user interface 80 provided with various operation keys and a liquid crystal display (LCD), a communication interface 90 communicable with an external personal computer (PC) 200, and the controller 100. The controller 100 controls each element of the laser printer 1 to achieve various functions.

Specifically, the controller 100 includes a CPU 101, a ROM 103 that stores various programs, a RAM 105 utilized as a work area when the CPU 101 executes a program, and an NVRAM 107 such as a flash memory that is a non-volatile memory configured to electrically rewrite data. The controller 100 controls each element included in the laser printer 1 to achieve various functions, by executing various processes with the CPU 101 in accordance with data stored on the NVRAM 107 and the programs stored on the ROM 103.

Specifically, when receiving PDL data as image data described in a page description language (PDL) from the external PC 200, the controller 100 determines that a print command is input, and rasterizes the received PDL data to form print image data. Based on the print image data, the controller 100 controls the scanner unit 10 to sequentially form an electrostatic latent image for each color of cyan, magenta, yellow, and black on the photoconductive belt 22. Further, when forming the electrostatic latent image, the controller 100 controls the development unit 11 to develop the electrostatic latent image with toner of a corresponding color. Thereby, a color developer image based on the print image data is formed on the intermediate transfer belt 26 with the developer images of the four colors formed on the photoconductive belt 22 being mutually superimposed.

Further, in response to the color developer image being completely formed on the intermediate transfer belt 26, the controller 100 controls the feed unit 4 to feed a sheet 3 to the secondary transfer point C. Thus, through the control by the controller 100, the color developer image formed on the intermediate transfer belt 26 is transferred onto the sheet 3, and the image based on the aforementioned PDL data is formed on the sheet 3, and the printed sheet 3 is ejected onto the catch tray 43.

Further, when creating the print image data by rasterizing the PDL data, the controller 100 adjusts the density of each pixel included in the print image data to suit input/output (I/O) characteristics of the recording device 70 on the basis of density correction data stored on the NVRAM 107. Thereby, the controller 100 presents an output image kept of high image quality, meeting the change in the I/O characteristics of the recording device 70 due to changes over time or in the environment.

The density correction data for each color of cyan, magenta, yellow, and black is stored on the NVRAM 107 and updated by a calibration operation.

More specifically, the controller 100 gives predetermined test pattern data to the recording device 70 and causes the recording device 70 to form a test pattern (a developer image) corresponding to the test pattern data. Additionally, the controller 100 evaluates the I/O characteristics of the recording device 70 by measuring the density of the test pattern with a density sensor 71 provided to face the intermediate transfer belt 26 and updates the density correction data stored on the NVRAM 107.

Figure 3:
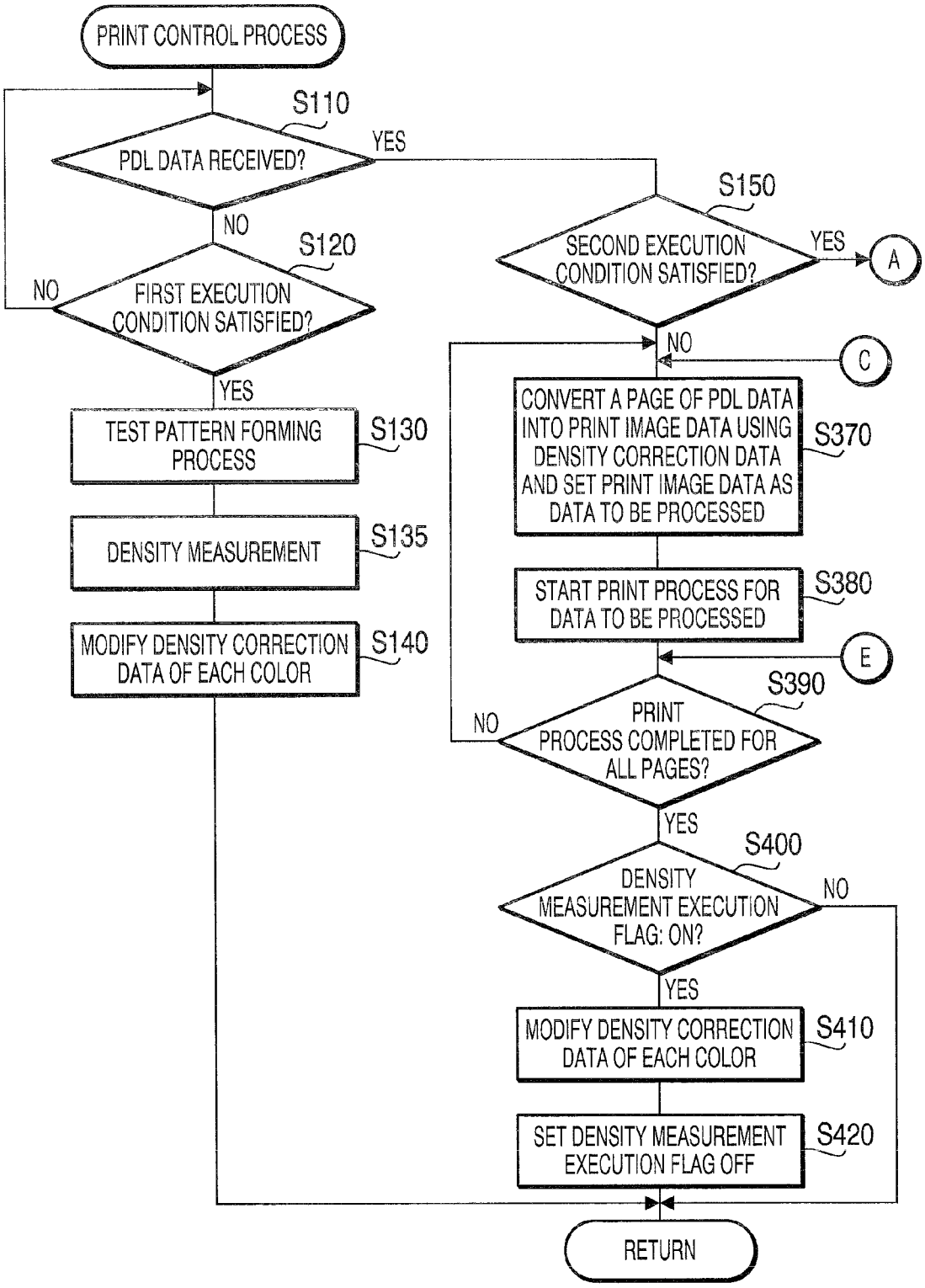
FIGS. 3 to 5 are flowcharts showing a procedure of a print control process to be executed by a controller of the laser printer in the embodiment according to one or more aspects of the present invention.
Figure 4:
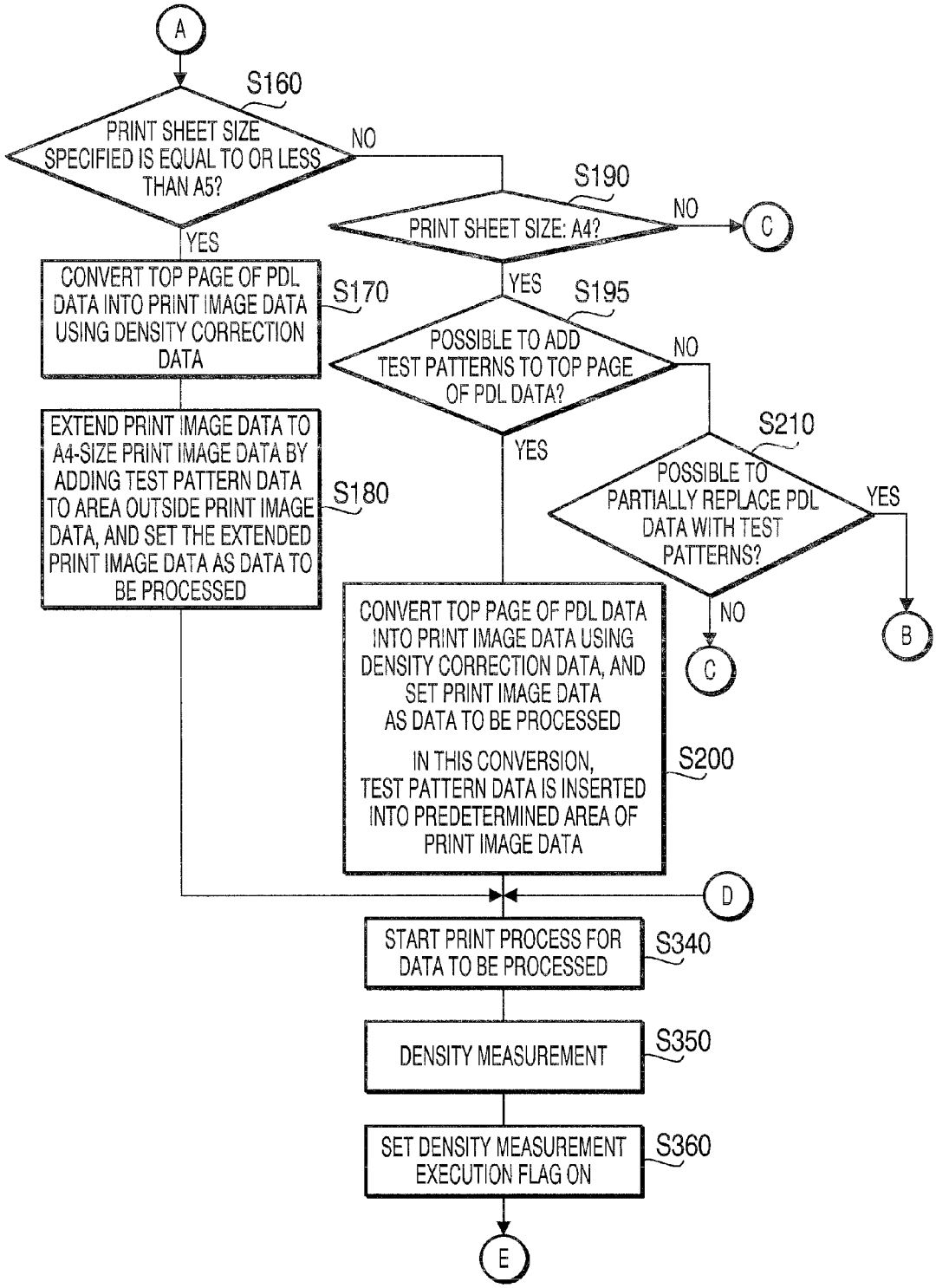
Figure 5:
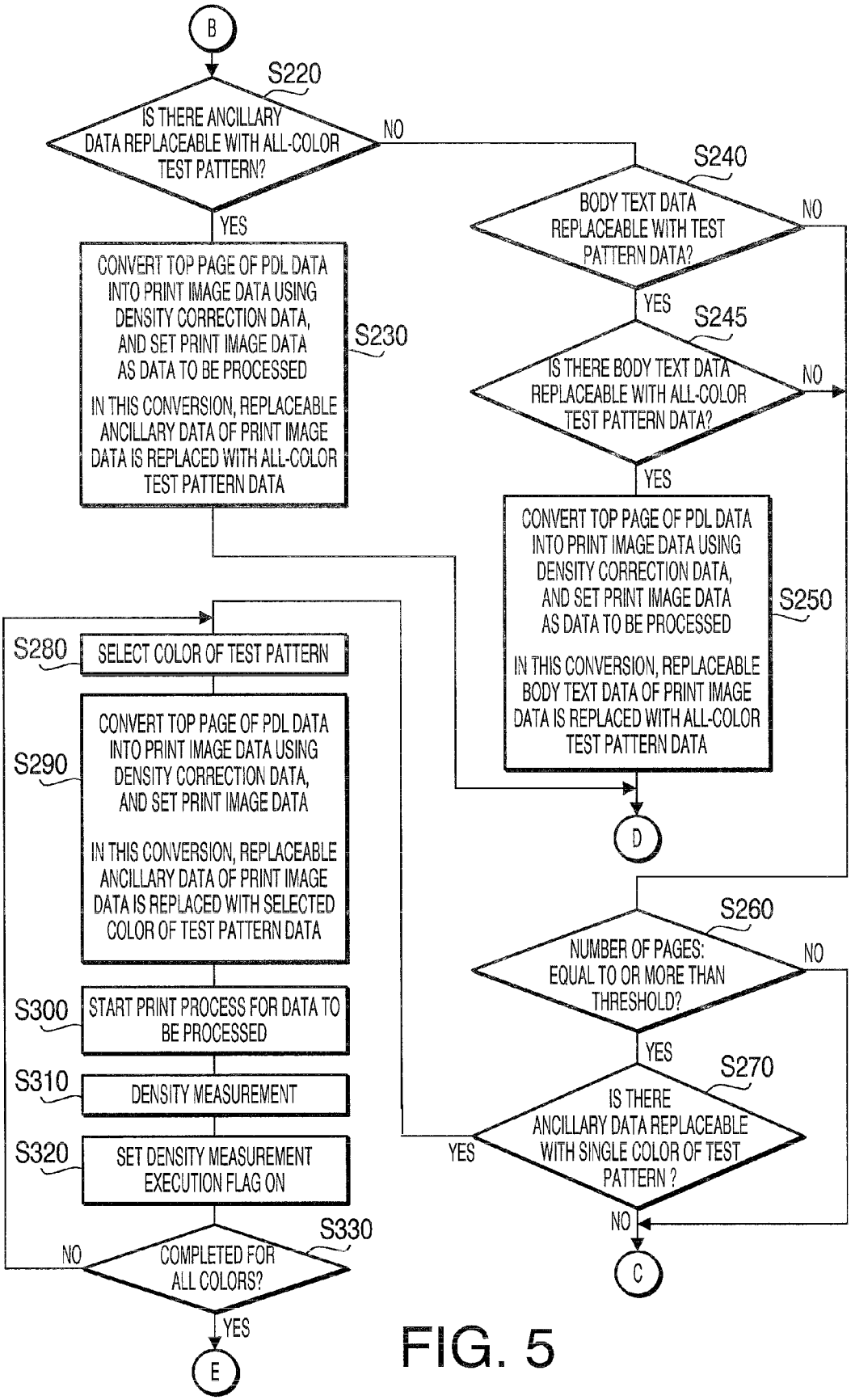

Subsequently, a print control process to be executed by the controller 100 will be described in detail. FIGS. 3 to 5 are flowcharts showing a procedure of a print control process to be repeatedly performed by the controller 100. In the print control set forth in detail below, when a first execution condition for calibration is satisfied, the controller 100 independently performs the calibration operation in the same manner as a known printer. Meanwhile, when a second execution condition for calibration is satisfied at the time when the PDL data to be printed is received from the external PC 200, the controller 100 performs the calibration operation in parallel with an operation of forming the image based on the received PDL data.

Specifically, an execution condition is determined based on a time period that has elapsed since the last modification of the density correction data. The controller 100 determines that an execution condition is satisfied when the time period that has elapsed since the last modification of the density correction data is over a predetermined threshold.

A threshold TH2 of the second execution condition is set to a lower value than a threshold TH1 of the first execution condition. In other words, the laser printer 1 in the embodiment is configured such that the first execution condition is not satisfied while the density correction data is being updated by the calibration operation executed in response to the second execution condition being satisfied.

When the print control process shown in FIG. 3 is started, the controller 100 first waits until the PDL data to be printed is received from the external PC 200 or until the first execution condition for calibration is satisfied (S110 and S120).

Then, when the time period that has elapsed since the last modification of the density correction data is over the threshold TH1, the controller 100 determines that the first execution condition is satisfied (S120: Yes), and then advances to S130.

In S130, the controller 100 performs a test pattern forming process in the same manner as a known printer (S130). Specifically, in the state where the feed unit 4 is forbidden to feed the sheets 3, the controller 100 causes the recording device 70 to form, as a developer image, filled images (test patterns) of the four colors (cyan, magenta, yellow, and black) which images are arranged in a lateral direction perpendicular to the traveling direction of the intermediate transfer belt 26 in an area on the intermediate transfer belt 26 where the density sensor 71 can measure the density of the developer image (see FIG. 6).

Hereinafter, a test pattern, which includes the respective test patterns of the four colors (cyan, magenta, yellow, and black) arranged in the lateral direction, will be referred to as an "all-color test pattern." In addition, data for forming the "all-color test pattern" will be referred to as "all-color test pattern data."

Then, the controller 100 causes the density sensor 71 to measure the density of the test pattern of each color and acquires, from the density sensor 71, density information regarding the density of the test pattern of each color (S135). FIG. 6 shows a positional relationship between a setting position of the density sensor 71 and a position where the test patterns are formed on the intermediate transfer belt 26 in S130. As illustrated in FIG. 6, in the laser printer 1 of the embodiment, the density sensor 71 is disposed to face a boundary region BR on the intermediate transfer belt 26, which region is laterally outside an area where an A5-size image (developer image) is formed and inside an area where an A4-size image is formed. In the test pattern forming process, the all-color test pattern is formed as a developer image on the boundary region BR.

In FIG. 6, color differences among the test patterns of the four colors are represented using hatching patterns. It is noted that the test patterns actually formed are images filled with the respective colors. After S135, the controller 100 proceeds to S140, in which the controller 100 identifies relationships in the test patterns between input values and densities of the output images, that is, the I/O characteristics of the recording device 70, on the basis of the density information, acquired in S135, of the test patterns of the four colors. Then, the controller 100 modifies (updates) the density correction data of each color stored on the NVRAM 107 to conform to the I/O characteristics identified (S140).

It is noted that a method employed here to modify the density correction data is the same as a calibration operation performed by a known laser printer. Therefore, detailed explanation of the method will be omitted. In the embodiment, thus, by updating the density correction data, image quality adjustment is performed for an image which the recording device 70 forms on the sheet 3. Thereafter, the print control process is terminated.

Meanwhile, when receiving the PDL data from the external PC 200 via the communication interface 90 (S110: Yes), the controller 100 determines whether the second execution condition for calibration is satisfied at the present time (S150).

Specifically, the controller 100 determines whether the time period that has elapsed since the last modification of the density correction data is over the threshold TH2. When the elapsed time period is over the threshold TH2, the controller 100 determines that the second execution condition is satisfied (S150: Yes) and advances to S160. Meanwhile, when the elapsed time period is equal to or less than the threshold TH2, the controller 100 determines that the second execution condition is not satisfied (S150: No) and proceeds to S370.

In S370, the controller 100 rasterizes a page of the PDL data received from the external PC 200 via the communication interface 90 to create print image data of a sheet size specified as a print sheet size by the external PC 200, namely, the sending source of the PDL data. The controller 100 sets the created print image data as data to be processed. It is noted that, when creating the print image data, the controller 100 corrects a value of each pixel (input value) to conform to the I/O characteristics of the recording device 70 with reference to the density correction data of each color stored on the NVRAM 107.

After S370, the controller 100 causes the recording device 70 to start a print process for the data to be processed (S380). Specifically, the controller 100 controls the recording device 70 to form, on the intermediate transfer belt 26, a developer image based on the data to be processed, and then to transfer the developer image formed on the intermediate transfer belt 26 onto the sheet 3 fed from the feed unit 4 to the secondary transfer point C. Thus, the controller 100 performs, as the print process, an operation of forming on the sheet 3 a color image based on the data to be processed.

In addition, after S380, the controller 100 advances to S390, in which the controller 100 determines whether the print process is performed for all pages of the received PDL data (S390). When determining that the print process is not performed for all pages of the received PDL data (S390: No), the controller 100 goes to S370 to create print image data of a next page and set the print image data as data to be processed (S370). Then, at the time when the print process for the previous page is completed, the print process for the data to be processed is launched (S380). Thus, in the steps of S370 to S390, the print process is carried out for the top page to the final page of the received PDL data.

When the print process is performed for all the pages (S390: Yes), it is determined whether a density measurement flag is set ON (S400). It is noted that the density measurement flag is set OFF at the time to start the print control process and set ON in below-mentioned steps S320 and S360.

When determining that the density measurement flag is set ON (S400: Yes), the controller 100 advances to S410. Meanwhile, when determining that a density measurement flag is set OFF (S400: No), the controller 100 terminates the print control process without executing S410 or S420.

When the density measurement flag is set ON in the below-mentioned step S320 or S360 (S400: Yes), the controller 100 proceeds to S410, in which the controller 100 updates the density correction data of each color stored on the NVRAM 107 based on the latest density information for the test pattern. Specifically, the controller 100 modifies the density correction data of each color stored on the NVRAM 107 to conform to the I/O characteristics of the recording device 70 specified by the latest density information. Further, after modifying the density correction data, the controller 100 sets the density measurement flag OFF (S420), and thereafter terminates the print control process.

Subsequently, a description will be given to set forth a process to be executed in S160 and the subsequent steps when the second execution condition of the calibration operation is satisfied (S150: Yes). The controller 100 advances to S160, in which the controller 100 first determines whether the print sheet size specified by the sending source of the PDL data (i.e., the external PC 200) is equal to or less than A5 (S160). Namely, it is determined whether the sending source of the PDL data (i.e., the external PC 200) designates printing on a sheet of a size equal to or less than A5.

When determining that the print sheet size specified is equal to or less than A5 (S160: Yes), the controller 100 proceeds to S170, in which the controller 100 rasterizes a top page of the received PDL data using the density correction data stored on the NVRAM 107 and converts the top page into print image data of the sheet size specified by the sending source of the PDL data, in the same manner as implemented in S370.

In addition, after creating the print image data, the controller 100 adds a white area to the outside of the print image data and expands the print image data to A4-size print image data. It is noted that, at the time of this expansion, the controller 100 creates the A4-size print image data with the all-color test pattern data for forming the all-color test pattern being added in an region where the density measurement can be performed by the density sensor 71 located outside an area of the print image data of the sheet size specified by the sending source of the PDL data. Then, the controller 100 sets the A4-size print image data as data to be processed (S180).

FIG. 7 shows an example in which the A5-size print image data is extended to the A4-size print image data in S180. Namely, in S180, the controller 100 creates the print image data such that the all-color test pattern is formed outside the area of the print image of the sheet size specified by the sending source of the PDL data on the intermediate transfer belt 26, and then sets the created print image data as data to be processed. It is noted that the positional relationship between the intermediate transfer belt 26 and the test patterns, set forth here, is as shown in FIG. 6. Further, the positional relationship shown in FIG. 6 also applies to a relationship between the photoconductive belt 22 and the test patterns.

After S180, the controller 100 proceeds to S340, in which the controller 100 starts the print process for the data to be processed that has been set in S180 in the same manner as implemented in S380. In the embodiment, although the print sheet size is specified by the external PC 200 that is the sending source of the PDL data, when the sheets 3 are fed from the feed unit 4, without detecting the size of the sheets to be fed that are placed on the feed tray 6, the controller 100 feeds the sheets 3 placed on the feed tray 6 to the secondary transfer point C under an assumption that the sheets 3 of the size designated by the external PC 200 are placed on the feed tray 6.

Accordingly, when the print process is performed in S340 for the data to be processed that has been set in S180, the sheets 3 of a size equal to or less than A5 are fed to the secondary transfer point C in the case where the sheets 3 of the size specified by the external PC 200, which is the sending source of the PDL data, are rightly placed on the feed tray 6.

In the meantime, as described above, the print image data to be treated in S340 has been extended to the A4-size image data. Therefore, when the sheets 3 of a right size are placed on the feed tray 6, the image based on the received PDL data is only transferred from the intermediate transfer belt 26 onto the sheet 3 fed, and the all-color test pattern is not transferred onto the sheet 3.

After S340, the controller 100 causes the density sensor 71, which faces the intermediate transfer belt 26, to measure the density of the test pattern of each color that is formed in such a position, and acquires the density information of the test pattern of each color from the density sensor 71 (S350). Thereafter, the controller 100 sets the aforementioned density measurement execution flag ON (S360), and then goes to S390.

Thus, when determining that the print sheet size specified by the sending source of the PDL data (i.e., the external PC 200) is equal to or less than A5 (S160: Yes), the controller 100 forms the top page of the PDL data and the all-color test pattern on the intermediate transfer belt 26 with any test pattern kept from being formed on the sheet 3 (S340), and performs the density measurement for the test pattern of each color (S350). Then, the controller 100 performs the print process for the second page and the subsequent pages of the PDL data in S370 to S390, and at the time when the print process is performed for all the pages, determines that the density measurement flag is set ON (S400: Yes). Thereafter, based on the density information of the test pattern of each color that has been acquired in S350, the controller 100 modifies the density correction data of each color (S410). After modifying the density correction data of each color, the controller 100 sets the density measurement execution flag OFF and terminates the print control process.

Meanwhile, when the controller 100 goes to S190 after determining that the print sheet size specified by the sending source of the PDL data (i.e., the external PC 200) is not equal to or less than A5 (S160: No), the controller 100 determines whether the print sheet size specified by the external PC 200 (i.e., the sending source of the PDL data) is A4 (S190). It is noted that the laser printer 1 of the embodiment is configured to feed sheets of any standard size equal to or less than A4. When the print sheet size specified by the external PC 200 that is the sending source of the PDL data is B5, the controller 100 determines that the print sheet size specified by the external PC 200 that is the sending source of the PDL data is not A4 (S190: No).

When determining that the print sheet size specified by the external PC 200 that is the sending source of the PDL data is A4 (S190: Yes), the controller 100 goes to S195. Meanwhile, when determining that the print sheet size specified is less than A4 (S190: No), the controller 100 determines that the formation of the test patterns cannot be performed in parallel with the formation of the image based on the PDL data because of the density sensor 71 fixed and goes to S370. Further, when the controller 100 goes to S370, the controller 100 performs a normal print process based on the PDL data. Namely, in the steps of S370 to S390, the controller 100 forms on a sheet 3 each page of print image based on the PDL data. In addition, after performing the print process for all the pages, the controller 100 determines that the density measurement flag is set OFF (S400: No) and terminates the print control process.

Meanwhile, when the controller 100 determines that the print sheet size specified is A4 (S190: Yes) and goes to S195, the controller 100 determines whether the test patterns can be added onto the top page of the PDL data, on the basis of setting parameters for calibration transmitted along with the PDL data.

FIG. 8 illustrates a configuration of a printer setting screen which the external PC 200 displays for the user on a display device thereof based on a printer driver installed into the external PC 200. As shown in FIG. 8, the printer driver adapted to the laser printer 1 is configured to accept the setting parameters for calibration from the user. It is noted that the setting parameters are transmitted by the external PC 200 along with the PDL data as mentioned above.

Specifically, the setting parameters for calibration include a parameter (insertion of patch data) that represents whether the test patterns can be added to the top page of the PDL data, a parameter (conversion into patch data) that represents whether the images included in the PDL data are partially replaced with the test patterns, and a parameter that represents a range of data replaceable with the test patterns. The parameter representing the replaceable data range takes one of a value (all data) representing that the replaceable data range is all data and a value (only ancillary data) representing that the replaceable data range is only ancillary data.

When determining that the test patterns can be added to the top data of the PDL data, based on the setting parameters received along with the PDL data (S195: Yes), the controller 100 goes to S200. Meanwhile, when determining that the test patterns cannot be added to the top data of the PDL data (S195: No), the controller 100 goes to S210.

In S200, the controller 100 converts the top page of the received PDL data into print image data of the sheet size specified by the external PC 200 (i.e., the sending source of the PDL data) that conforms to the I/O characteristics of the recording device 70, using the density correction data of each color stored on the NVRAM 107. Additionally, the controller 100 inserts the all-color test pattern into a predetermined area of the converted print image data (S200). Specifically, as illustrated in the lowest portion of FIG. 9A, the all-color test pattern is inserted in a left end area of a footer area (where the density measurement can be made with the density sensor 71). Then, the print image data with the all-color test pattern added thereto is set as data to be processed.

Namely, in S200, the area of the print image data where other images are supposed to be formed based on the received PDL data (here, which includes a white area where any image is not substantially formed) is forcibly replaced with the all-color test pattern. Thus, the print image data with the all-color test pattern data inserted thereinto is created and set as data to be processed.

After S200, the controller 100 goes to S340, in which the controller 100 starts the print process for the data to be processed that has been set in S200. Then, the controller 100 causes the density sensor 71 to measure the test pattern of each color formed on the intermediate transfer belt 26 in the print process, and acquires the density information of the test pattern of each color (S350). Thereafter, the controller 100 sets the density measurement execution flag ON (S360) and goes to S370.

Thus, in the case where the controller 100 determines that the test patterns can be added to the top data of the PDL data (S195: Yes), the controller 100 forms the all-color test pattern in the left end of the footer area on the top page when forming the print image of the top page on the basis of the PDL data. Further, the controller 100 causes the density sensor 71 that faces the intermediate transfer belt 26 to measure the density of the test pattern of each color. With the modification of the density correction data being put on hold, the controller 100 performs the print process for the second page and the subsequent pages on the basis of the PDL data (S370 to S390). Thereafter, at the time when the print process is performed for all the pages, the controller 100 determines that the density measurement flag is set ON (S400: Yes) and modifies the density correction data of each color based on the density information of the test patterns that has been acquired in S350 (S410). Then, after modifying the density correction data of each color, the controller 100 sets the density measurement execution flag OFF (S420) and terminates the print control process.

Meanwhile, when the controller 100 goes to S210, the controller 100 determines whether the images included in the PDL data can partially be replaced with the test patterns, based on the setting parameters for calibration transmitted along with the PDL data (S210). When the controller 100 determines that the images included in the PDL data can partially be replaced with the test patterns (S210: Yes), the controller 100 proceeds to S220. Meanwhile, when the controller 100 determines that the images included in the PDL data cannot partially be replaced with the test patterns (S210: No), the controller 100 proceeds to S370, and in the same manner as implemented when it is determined that the print sheet size specified is not A4 (S190: No), the controller 100 performs the normal print process based on the PDL data and forms on a sheet 3 each page of print image based on the PDL data (S370 to S390). Further, after it is determined that the print process is performed for all the pages included in the PDL data (S390: Yes), the controller 100 determines that the density measurement execution flag is set OFF (S400: No) and terminates the print control process.

Meanwhile, when the controller 100 goes to S220, the controller 100 determines whether any ancillary data replaceable with the all-color test pattern data exists in the PDL data (S220). It is noted that the ancillary data means data that represents an ancillary image to be printed in a header area or a footer area on a sheet, such as footer image data and header image data. It is possible to cite, as the ancillary data, data representing a page number, a date/time, a file name, or a user name.

It is noted that the printer driver adapted to the laser printer 1 of the embodiment is configured to change settings regarding whether to separately print, as an ancillary image, each information such as a page number, a date/time, a file name, and a user name, in response to an instruction issued by the user. In addition, the printer driver is configured to create PDL data with ancillary data added thereto that represents one or more ancillary images which the user has decided to print in addition to a user-intended body text. Further, the printer driver is configured to transmit the created PDL data to the laser printer 1.

Additionally, the printer driver is configured to create image data (PDL data) with such a page layout that the ancillary images are printed in areas above and beneath the body text image by arranging the body text data in a central body text area and the ancillary images in a header area above the body text area or a footer area beneath the body text area. Furthermore, each of the header area and the footer area is sectioned into three areas. The printer driver arranges each image of the ancillary data in a predetermined position within any one of a left area, a central area, and a right area of the header area or in a predetermined position within any one of a left area, a central area, and a right area of the footer area.

In the meantime, as illustrated in FIG. 6, the density sensor 71 of the embodiment is fixed in such a position as to be able to measure the density of the developer image transferred into the left end area of an A4-size sheet. Therefore, in S220, by analyzing the PDL data, the controller 100 determines whether there is ancillary data, to which a print area wider than the all-color test pattern is assigned, to be printed in the left end area of the footer area or the header area where the density sensor 71 can make the density measurement. Thereby, in S220, it is determined whether the ancillary data replaceable with the all-color test pattern data exists in the PDL data.

Specifically, in the embodiment, the test pattern of each color has a predetermined vertical length and a predetermined horizontal length. In this situation, when the print area assigned to the ancillary data is wider in the vertical direction than the all-color test pattern and four times as wide in the horizontal direction as the all-color test pattern, it is determined that ancillary data replaceable with the all-color test pattern data exists in the PDL data.

When determining that ancillary data replaceable with the all-color test pattern data exists in the PDL data (S220: Yes), the controller 100 advances to S230. Meanwhile, when determining that ancillary data replaceable with the all-color test pattern data does not exist in the PDL data (S220: No), the controller 100 proceeds to S240.

In S230, the controller 100 creates print image data by rasterizing the top page of the received PDL data in the same manner as implemented in S370. Further, at this time, the aforementioned replaceable ancillary data is replaced with the all-color test pattern data, and the print image data after the replacement is set as data to be processed.

It is noted that for example, the method for replacing the replaceable ancillary data with the all-color test pattern data at the time of the rasterizing may include a way to replace the replaceable ancillary data contained in the PDL data with the all-color test pattern data described in the page description language (PDL) and then rasterize the PDL after the replacement, and a way to once rasterize the PDL data as a whole and then replace an area of the print image data corresponding to the replaceable ancillary data after the rasterizing with the all-color test pattern data as raster image data.

Furthermore, in the embodiment, when the ancillary data replaceable with the all-color test pattern data is arranged in both of the footer area and the header area, the ancillary data in the footer area is preferentially replaced with the test pattern data.

Specifically, in S220, an examination as to whether ancillary data replaceable with the all-color test pattern data exists in the PDL data is conducted preferentially from the footer area. When there is no ancillary data replaceable with the all-color test pattern data in the footer area, the header area is examined (see FIG. 9B). When there is ancillary data replaceable with the all-color test pattern data in the left end area of the footer area, the ancillary data is replaced with the all-color test pattern data in S230. Meanwhile, when there is ancillary data replaceable with the all-color test pattern data not in the left end area of the footer area but in the left end area of the header area, the ancillary data is replaced with the all-color test pattern data in S230.

Here, a specific example of a procedure of the steps S220 to S230 will be given with reference to FIGS. 9A and 9B. In each of FIGS. 9A and 9B, ancillary data representing a page number is attached to the left end area of the footer area. As illustrated in FIG. 9A, when the page number is described with more than four characters, as it is determined in S220 that there is ancillary data replaceable with the all-color test pattern data in the left end area of the footer area (S220: Yes), the ancillary data is replaced with the all-color test pattern data.

Meanwhile, as illustrated in FIG. 9B, when the page number is described with three characters, it is determined in S220 that there is no ancillary data replaceable with the all-color test pattern data in the left end area of the footer area (S220: No), and the header area is next examined as to whether there is ancillary data replaceable with the all-color test pattern data in the left end area of the footer area.

After the determination in S230, the controller 100 goes to S340, in which the controller 100 launches the print process for the data to be processed that has been set in S230. Then, the controller 100 causes the density sensor 71 to measure the density of the all-color test pattern formed on the intermediate transfer belt 26 and acquires the density information of the test pattern of each color (S350). After that, the controller 100 sets the density measurement execution flag ON (S360) and performs the print process for the second page and the subsequent pages (S370 to S390). At the time when the print process is performed for all the pages (S390: Yes), based on the density information of the test pattern of each color that has been acquired in S350, the controller 100 modifies the density correction data of each color (S410) and sets the density measurement execution flag OFF. Thereafter, the print control process is terminated.

Further, when going to S240, the controller 100 determines whether the body text data contained in the PDL data is replaceable with the test pattern data, on the basis of the aforementioned setting parameters for calibration transmitted along with the PDL data. Specifically, when the data range indicated by a corresponding one of the setting parameters is the value representing "all data," it is determined that the body text data is replaceable with the test pattern data. Meanwhile, when the data range indicated by the corresponding one of the setting parameters is the value representing "only ancillary data," it is determined that the body text data is not replaceable with the test pattern data.

When the body text data is replaceable with the test pattern data (S240: Yes), the controller 100 goes to S245, in which the controller 100 determines whether there is body text data replaceable with the all-color test pattern data in the left end area of the body text area in the PDL data where the density sensor 71 can make the density measurement. Specifically, in S245, the controller 100 refers to the received PDL data and examines the left end area where the density measurement can be achieved with the density sensor 71 from the bottom to the top of the body text area between the header area and the footer area, as illustrated in FIG. 10. Then, the controller 100 determines whether there is body text data, to which a print area wider than the all-color test pattern is assigned, in the examined area (S245).

When determining that there is (arranged) body text data replaceable with the all-color test pattern data in the left end area of the body text area in the PDL data where the density sensor 71 can make the density measurement (S245: Yes), the controller 100 advances to S250. In S250, the controller 100 creates print image data of the top page of the received PDL data by replacing, with the all-color test pattern data, body text data, replaceable with the all-color test pattern data, which is located at the lowermost side in the body text area.

Specifically, the controller 100 creates the print image data by rasterizing the top page of the received PDL data in the same manner as implemented in S370. At this time, the controller 100 replaces the aforementioned replaceable body text data with the all-color test pattern data. Then, the controller 100 sets the print image data after the replacement as data to be processed. Further, after completing the step S250, the controller 100 goes to S340.

Meanwhile, when the controller 100 determines that the body text data contained in the PDL data is not replaceable with the test pattern data (S240: No) or that there is no body text data replaceable with the all-color test pattern data in the left end area of the body text area in the PDL data where the density sensor 71 can make the density measurement (S245: No), the controller 100 goes to S260. In S260, the controller 100 determines whether the number of pages of the received PDL data is equal to or more than a threshold corresponding to the number of the primary colors used for color image formation (S260). Specifically, in the embodiment, the controller 100 determines whether the number of the pages of the received PDL data is equal to or more than four.

When determining that the number of the pages of the received PDL data is less than four (S260: No), the controller 100 goes to S370 to perform the same process as executed in the case of the negative determination in S190 (S190: No) or the negative determination in S210 (S210: No).

On the contrary, when determining that the number of the pages of the received PDL data is equal to or more than four (S260: Yes), the controller 100 goes to S270, in which the controller 100 determines whether there is ancillary data replaceable with a single color of test pattern data in the same manner as implemented in S220.

It is noted that, as exemplified in FIG. 9, when there is ancillary data in the left end area where the density sensor 71 can make the density measurement in at least one of the footer area and the header area, the ancillary data can be replaced with any color of test pattern data. Therefore, when there is ancillary data in the left end area of the footer area or the header area, it is determined that there is ancillary data replaceable with a single color of test pattern data in the PDL data (S270: Yes). Meanwhile, when there is no ancillary data in the left end area in the footer area or the header area, it is determined that there is no ancillary data replaceable with a single color of test pattern data in the PDL data (S270: No).

When determining that there is no ancillary data replaceable with a single color of test pattern data in the PDL data (S270: No), the controller 100 goes to S370, in which the controller 100 carries out the same process as implemented when it is determined that the number of the pages of the received PDL data is less than four (S260: No). Meanwhile, when determining that there is ancillary data replaceable with a single color of test pattern data in the PDL data (S270: Yes), in the steps S280 to S330, the controller 100 achieves the test pattern formation by separating the test pattern data of the four colors on a color-by-color basis and incorporating an intended one piece of the separated test pattern data into each page.

More particularly, when the controller 100 gives the positive determination in S270 (S270: Yes) and goes to S280, the controller 100 selects an intended color for forming a test pattern among the four colors, cyan, magenta, yellow, and black (S280).

After that, the controller 100 goes to S290, in which the controller 100 creates print image data by rasterizing a single page of the received PDL data (a page with the smallest page number among pages for which the print process has not been performed) (S290). At this time, the aforementioned replaceable ancillary data is replaced with the selected color of test pattern data. Then, the print image data after the replacement is set as data to be processed. It is noted that a method for replacing the replaceable ancillary data with the selected color of test pattern data at the time of the rasterizing is the same as implemented in S230.

Thereafter, the controller 100 starts the print process for the data to be processed that has been set in S290 (S300). The controller 100 causes the density sensor 71 to measure the density of the test pattern formed on the intermediate transfer belt 26 in the print process, and acquires the density information of the selected color of test pattern (S310). The controller 100 sets the density measurement execution flag ON (S320) and goes to S330.

Further, the controller 100 determines in S330 whether the steps of S290 to S310 are executed for all the four colors of cyan, magenta, yellow, and black (S330). When determining that the steps of S290 to S310 are executed for all the four colors (S330: No), the controller 100 goes to S280 to select one of colors that have not selected as an intended color for forming a test pattern, and then performs S290 and the subsequent steps. Then, the controller 100 causes the density sensor 71 to measure the density of the test pattern formed on the intermediate transfer belt 26 in the print process based on the PDL data, and acquires the density information (S310).

Thus, the controller 100 performs the print process for the top page to the fourth page of the PDL data with respect to the respective four colors of cyan, magenta, yellow, and black, and measures the densities of the test patterns. Then, when determining that the steps of S290 to S310 are executed for all the four colors (S330: Yes), the controller 100 proceeds to S390.

When the print process is not performed for all the pages included in the PDL data (S390: No), the controller 100 proceeds to S370 to perform the print process for the fifth page and the subsequent pages (S370 to S380). When the print process is performed for all the pages of the PDL data (S390: Yes), the controller 100 determines that the density measurement execution flag is set ON (S400: Yes), and then modifies the density correction data of each color stored on the NVRAM 107 on the basis of the density information of the test pattern of each color that has been acquired in S310 (S410). Furthermore, after setting the density measurement execution flag OFF (S420), the controller 100 terminates the print control process.

Here, explanation will be given to set forth a specific operation in the case where it is determined that there is ancillary data replaceable with a single color of test pattern data (S270: Yes), with reference to FIG. 11. In this case, for example, the controller 100 forms the test pattern of cyan in the footer area on the first page, the test pattern of magenta in the footer area on the second page, the test pattern of yellow in the footer area on the third page, and the test pattern of black in the footer area on the fourth page. Then, the controller 100 acquires the density information of the test pattern of each color and modifies the density correction data.

Hereinabove, the configuration of the laser printer 1 in the embodiment has been described. According to the embodiment, when the first execution condition is satisfied, the calibration operation is performed separately in a known way. Meanwhile, when the first execution condition is not satisfied, when converting the PDL data received from the external PC 200 via the communication interface 90 into the print image data, the controller 100 performs the calibration operation in parallel with the image formation based on the received PDL data, by processing the print image data to partially replace the PDL data with the test pattern data.

Hence, according to the laser printer 1 in the embodiment, when the user transmits PDL data from the external PC 200 and uses the laser printer 1 with high frequency, it is possible to relieve frustration that the user feels when the first execution condition is not satisfied and the calibration operation is separately performed. In other words, it is possible to prevent the image formation based on the PDL data received from the external PC 200 from being performed later than the calibration operation because of the calibration operation separately performed. Thus, it is possible to prevent the user from feeling discontented with the user-desired operation interrupted by the calibration operation.

Further, in the embodiment, PDL data is transmitted from the external PC 200, which data has a page layout in which ancillary images are attached to specific areas around the body text area (an upper left area, an upper central area, and an upper right area above the body text area, and a lower left area, a lower central area, and a lower right area beneath the body text area). When an attempt is made to replace any of the body text data and the ancillary data included on the PDL data (print image data) with the test pattern data, ancillary data with a lower value of information than the body text data is preferentially replaced with the test pattern data. Thus, according to the embodiment, even though the received PDL data is partially replaced with the test pattern data, it is possible to prevent the user from feeling discontented. Namely, in the embodiment, it is possible to prevent the user from feeling frustration newly caused by the data replacement, and to efficiently perform the calibration operation in parallel with the image formation based on the data received from the external PC 200.

Further, in the embodiment, when a print area assigned to the ancillary data is too small to form the all-color test pattern in the print area, the calibration operation is achieved by replacing the body text data with the test pattern data, or by forming a separated one of the test patterns of the four colors on each of a plurality of pages.

Thus, according to the laser printer 1, even when any ancillary data is not attached to the PDL data, or the ancillary data cannot be replaced with the all-color test pattern data, the calibration operation can be performed at the same time as the image formation based on the PDL data. Namely, promptly after the second execution condition is satisfied, the calibration operation can be performed. Thus, it is possible to perform the calibration operation efficiently and appropriately.

Further, the laser printer 1 of the embodiment made the negative determination in S195 (S195: No) and S210 (S210: No), when the setting parameters, transmitted along with the PDL data, which are setting parameters for calibration to be configured in the external PC 200 through a user interface, include a parameter of a value to forbid adding a test pattern onto the top page of the PDL data, and a parameter of a value to forbid replacing part of the images included in the PDL data with the test patterns. Then, the laser printer 1 performs a normal print process to, without processing the PDL data received via the communication interface 90, convert the PDL data into print image data.

Thus, according to the embodiment, for a user who can accept the calibration operation separately performed, it is possible to avoid execution of the calibration operation in which the PDL data is processed. Namely, the calibration operation can be performed in a manner suitable for each user.

Further, in the embodiment, even though the user does not desire the calibration operation in which the PDL data is processed, when the size of a sheet 3 is so small that the test patterns can be formed in an area on the intermediate transfer belt 26 where the developer image is not transferred onto the sheet 3, in S170 and S180, the test pattern is formed in the area where the developer image is not transferred onto the sheet 3. Thereby, the calibration operation can be performed in parallel with the image formation based on the PDL data.

Thus, according to the embodiment, even though the user does not desire the calibration operation in which the PDL data is processed, it is possible to perform the calibration operation before the user realizes it and to reduce the frequency of the first execution condition being satisfied. Thereby, it is possible to prevent the user from feeling discontented with the calibration operation separately performed.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, the density sensor 71 is fixedly disposed inside the laser printer 1. However, the density sensor 71 may movably be provided inside the laser printer 1. Specifically, as illustrated in FIG. 12, the density sensor 71 may be mounted on a carriage movable along a guide shaft that extends in the direction perpendicular to the traveling direction of the intermediate transfer belt 26, so as to be movable in the direction perpendicular to the traveling direction of the intermediate transfer belt 26.

When the density sensor 71 is configured to be movable and the laser printer 1 is configured to determine the position of the density sensor 71 under motor control, the test patterns can be formed flexibly in an intended position. In this case, for example, it is possible to replace ancillary data corresponding to an ancillary image placed in a right area of the header area or the footer area and to form the test patterns in a center of the body text area.

Further, in the aforementioned embodiment, unless the print sheet size is A4, it is forbidden to replace the ancillary data or the body text data with the test pattern data. However, when the density sensor 71 is configured to be movable, even though the print sheet size is, for instance, B5, it is possible to perform the calibration operation in parallel with the image formation based on the PDL data by replacing the ancillary data or the body text data with the test pattern data.

Further, in the aforementioned embodiment, the density sensor 71 is disposed to face the intermediate transfer belt 26. However, the density sensor 71 may be disposed to face the photoconductive belt 22. Moreover, aspects of the present invention may be applied to not only a laser printer configured as the aforementioned embodiment but various kinds of image forming devices as well.

What is claimed is:

1. An image forming device configured to make image quality adjustment based on calibration data, comprising:

a storage configured to store the calibration data for the image quality adjustment;

an acquiring unit configured to acquire first image data;

a converter configured to, when a predetermined condition is satisfied, convert the first image data acquired by the acquiring unit into second image data by replacing part of the first image data with test pattern data for forming one or more test patterns;

an image forming unit configured to form an image based on the second image data on an image-formed body thereof;

a sensor configured to measure densities of the test patterns included in the image formed on the image-formed body; and a modifying unit configured to modify the calibration data stored on the storage based on the densities measured by the sensor.

2. The image forming device according to claim 1, wherein the first image data acquired by the acquiring unit includes image data with a page layout in which a main image represented by main image data is placed in a main area and one or more ancillary images represented by ancillary image data are attached to respective ancillary areas outside the main area, wherein the converter is configured to convert the first image data into the second image data by replacing at least part of the ancillary image data with the test pattern data.

3. The image forming device according to claim 2, further comprising a determining unit configured to determine whether the ancillary image data includes data replaceable with the test pattern data, wherein the converter is configured to, when the determining unit determines that the ancillary image data includes data replaceable with the test pattern data, convert the first image data into the second image data by replacing the replaceable data with the test pattern data, and wherein the converter is configured to, when the determining unit determines that the ancillary image data includes no ancillary image data replaceable with the test pattern data, convert the first image data into the second image data by replacing part of the main image data with the test pattern data.

4. The image forming device according to claim 2, wherein the ancillary image data includes at least one of header image data attached to a header area above the main area and footer image data attached to a footer area beneath the main area.

5. The image forming device according to claim 2, wherein the image forming unit is configured to form a color image using multiple primary colors, wherein the converter is configured to employ data for forming patterns respectively filled with the multiple primary colors, as the test pattern data with which the part of the first image data is to be replaced, wherein the image forming device further comprises:

a first determining unit configured to determine whether the ancillary image data includes data replaceable with the test pattern data; and a second determining unit configured to, when the first determining unit determines that the ancillary image data includes no data replaceable with the test pattern data, determine whether the main image data includes data replaceable with the test pattern data, and wherein the converter is configured to, when the second determining unit determines that the main image data includes no data replaceable with the test pattern data and a plurality of pages of the first image data are replaced with respective test pattern data, select one of the multiple primary colors used for forming the color image for each of the plurality of pages of the first image data, and replace part of the ancillary image data on each of the plurality of pages with test pattern data for forming a pattern filled with the selected primary color.

6. The image forming device according to claim 1, wherein the image forming unit is configured to form a color image using multiple primary colors, and wherein the converter is configured to employ data for forming patterns respectively filled with the multiple primary colors, as the test pattern data with which part of the first image data is to be replaced.

7. The image forming device according to claim 1, wherein the image forming unit is configured to form a color image using multiple primary colors, and wherein the converter is configured to, when a plurality of pages of the first image data are replaced with respective test pattern data, select one of the multiple primary colors used for forming the color image for each of the plurality of pages of the first image data, and replace part of each of the plurality of pages of the first image data with test pattern data for forming a pattern filled with the selected primary color.

8. The image forming device according to claim 1, wherein the image forming unit is configured to form a print image on a sheet by:

forming, on a photoconductive member of the image forming unit, an electrostatic latent image based on one of the first image data and the second image data;

forming a developer image by developing the electrostatic latent image formed on the photoconductive member with developing agent;

transferring the developer image onto the image-formed body; and transferring, onto the sheet, the developer image formed on the image-formed body.

9. The image forming device according to claim 8, wherein the sensor is disposed on a route to convey the developer image formed on the photoconductive member onto the image-formed body.

10. The image forming device according to claim 9, wherein the sensor is disposed to face the image-formed body.

11. The image forming device according to claim 9, wherein the sensor is configured to be movable.

12. The image forming device according to claim 8, further comprising a size determining unit configured to determine whether a size of the sheet on which the print image is to be formed by the image forming unit is equal to or less than a predetermined size, wherein, when the size determining unit determines that the size of the sheet is equal to or less than the predetermined size, the converter converts the first image data into the second image data by adding the test pattern data to the first image data, the first image data being data for forming a developer image based thereon within an area on the image-formed body that corresponds to the size of the sheet, the test pattern data being data for forming a developer image based thereon outside the area on the image-formed body.

13. The image forming device according to claim 8, further comprising a test pattern forming unit configured to, regardless of whether the first image data is acquired, when a predetermined requirement is satisfied, cause the image forming unit to form a developer image of a test pattern on the image-formed body in a state where a sheet is forbidden to be fed, wherein the sensor is configured to measure a density of the developer image of the test pattern formed on the image-formed body.

14. The image forming device according to claim 13, wherein the predetermined requirement includes a requirement that a first time period has elapsed since last time the calibration data was modified, wherein the predetermined condition includes a condition that a second time period has elapsed since the last time the calibration data was modified, and wherein the first time period is longer than the second time period.

15. The image forming device according to claim 1, further comprising:

a user interface configured to accept a user instruction; and a pattern formation permitting unit configured to permit or forbid to form the test patterns in accordance with the user instruction accepted through the user interface, wherein, when the pattern formation permitting unit permits to form the test patterns, the converter converts the first image data into second image data, and wherein, when the pattern formation permitting unit forbids to form the test patterns, the image forming unit forms an image based on the first image data on the image-formed body.

16. The image forming device according to claim 1, wherein the predetermined condition includes a condition that a predetermined time period has elapsed since last time the calibration data was modified.

17. A method for making image quality adjustment based on calibration data, comprising:

a storing step of storing the calibration data for the image quality adjustment;

an acquiring step of acquiring first image data;

a converting step of, when a predetermined condition is satisfied, converting the first image data acquired in the acquiring step into second image data by replacing part of the first image data with test pattern data for forming one or more test patterns;

a forming step of forming an image based on the second image data on an image-formed body;

a measuring step of measuring densities of the test patterns included in the image formed on the image-formed body; and a modifying step of modifying the calibration data stored in the storing step based on the densities measured in the measuring step.

18. A non-transitory computer readable medium having computer readable instructions stored thereon, the instructions causing a computer to perform:

a storing step of storing calibration data for image quality adjustment;

an acquiring step of acquiring first image data;

a converting step of, when a predetermined condition is satisfied, converting the first image data acquired in the acquiring step into second image data by replacing part of the first image data with test pattern data for forming one or more test patterns;

a forming step of forming an image based on the second image data on an image-formed body;

a measuring step of measuring densities of the test patterns included in the image formed on the image-formed body; and a modifying step of modifying the calibration data stored in the storing step based on the densities measured in the measuring step.

* * * * *

UNITED STATES PATENT AND TRADEMARK OFFICE

CERTIFICATE OF CORRECTION

PATENT NO. : 8,355,645 B2
APPLICATION NO. : 12/509750
DATED : January 15, 2013
INVENTOR(S) : Wataru Mizumukai It is certified that error appears in the above-identified patent and that said Letters Patent is hereby corrected as shown below:

On the Title Page, Item (54) and in the Specification, Column 1, Title should read:

IMAGE FORMING DEVICE FOR MAKING IMAGE QUALITY ADJUSTMENTS BASED ON CALIBRATION DATA, AND METHOD AND COMPUTER READABLE MEDIUM THEREFOR

Signed and Sealed this
Fourteenth Day of May, 2013

Teresa Stanek Rea
*Acting Director of the United States Patent and Trademark Office*